US005378242A

United States Patent [19]

Christie et al.

[11] Patent Number: 5,378,242

[45] Date of Patent: Jan. 3, 1995

[54] LIQUID ALKALI FOR SOAPING OFF REACTIVE DYES

[75] Inventors: Nick J. Christie, Burlington, N.C.; Samuel G. Jones, Blairs, Va.

[73] Assignee: Apollo Chemical Company, Burlington, N.C.

[21] Appl. No.: 994,718

[22] Filed: Dec. 22, 1992

[51] Int. Cl.[6] ..... D06B 1/00

[52] U.S. Cl. ..... 8/137; 8/137.5; 8/543; 8/544; 8/546; 8/217; 8/548; 8/549; 8/630; 8/631; 8/632; 252/99; 252/135; 252/156; 252/174.25

[58] Field of Search ..... 8/137, 137.5, 918, 543–549, 8/630–632; 252/99, 135, 156, 124.25

[56] References Cited

U.S. PATENT DOCUMENTS

| | | | |
|---|---|---|---|
| 1,812,557 | 6/1901 | Roberts et al. | 8/918 |
| 3,583,923 | 8/1971 | Cantrell et al. | 252/110 |
| 4,451,393 | 5/1984 | Watanabe et al. | 252/336 |
| 4,494,956 | 1/1985 | Schafer et al. | 8/543 |
| 4,500,320 | 2/1985 | Grunert et al. | 8/442 |
| 4,501,681 | 2/1985 | Groult et al. | 252/174.12 |
| 4,548,612 | 10/1985 | Kayane et al. | 8/524 |
| 4,555,348 | 11/1985 | Moran | 251/1 |
| 4,695,289 | 9/1987 | Töpfl | 8/573 |
| 4,725,287 | 2/1988 | Stehlin et al. | 8/107 |
| 4,731,092 | 3/1988 | Berendt | 8/477 |
| 4,902,439 | 2/1990 | Abel et al. | 252/174.25 |
| 4,915,865 | 10/1990 | Westermann | 252/157 |
| 4,950,416 | 8/1990 | Baxter | 252/99 |
| 4,988,365 | 1/1991 | Sternberger et al. | 8/918 |
| 5,047,064 | 9/1991 | Rizzardi | 8/125 |
| 5,061,290 | 10/1991 | Koshida et al. | 8/653 |
| 5,066,415 | 11/1991 | Dany et al. | 252/135 |
| 5,242,466 | 9/1993 | Aseervatham et al. | 8/543 |
| 5,246,467 | 9/1993 | Cockett | 8/917 |

OTHER PUBLICATIONS

Brochure entitled "REMOL FB" dated Jan. 1988.

*Primary Examiner*—Paul Lieberman
*Assistant Examiner*—K. Fries
*Attorney, Agent, or Firm*—Rhodes, Coats & Bennett

[57] ABSTRACT

A liquid alkali for use in soaping off of cotton and cotton blended fabrics. The liquid alkali is a water-based solution of an alkali metal hydroxide and an alkali metal silicate. Preferably the composition is an aqueous mixture of potassium hydroxide and sodium silicate. In the most preferred embodiment the composition includes 35 wt % potassium hydroxide at a 45 wt % concentration, 25 wt % sodium silicate at 50° Baumé, and the balance water. In an alternative embodiment, up to 5 wt % of a borate is added.

2 Claims, No Drawings

LIQUID ALKALI FOR SOAPING OFF REACTIVE DYES

BACKGROUND OF THE INVENTION (1) Field of the Invention

The present invention relates generally to the dyeing of textiles and, more particularly, to a liquid alkali for soaping off fiber reactive dyes from cotton and cotton blended fabrics.

(2) Description of the Prior Art

Fiber reactive dyes were first introduced in the mid 1950's. Since that time they nave become a dominant factor in dyeing cotton, regenerated cellulose and blends. These dyes can also be used to dye acrylics, nylon, silk, wool and blends of these fibers. Fiber reactive dyes are easy to apply and produce brilliant shades, fastness, penetration and leveling.

Fiber reactive dyes are anionic in nature and react chemically with the fiber. The dyes include a chromophore to give color to the dye and a reactive group to form a chemical bond with the fiber. There may also be a substitutent or solubilizing group which provides additional dyeing characteristics such as solubility, substantivity, migration, washing off, etc. Fiber reactive dyes react in the presence of alkali to form a strong covalent chemical bond between a carbon atom of the dye molecule and an oxygen atom of the hydroxyl group in the cellulose. This step is called "fixing".

Following the fixing step, the fabric is scoured to remove excess reactive dyes. This process is called "soaping off". Normally, soaping off includes a first rinse step, a soaping step, a second rinse step, and a drying step. Typically, soaps, such as phosphate-based detergents, are added during the soaping step to assist in removal of unreacted reactive dyes. However, heretofore, the liquid alkalis used during fixing have not been considered for use during soaping since they would not be expected to assist in excess dye removal. In addition, if the reaction mixture is too "hot" or alkaline, such as is seen with pure sodium hydroxide, the sensitive-type reactive dyes will hydrolyze with the water in the rinse bath and form a nonreactive pigment that has no effect on the fabric color.

Another liquid alkali which was recently introduced is sold under the tradename "REMOL FB". REMOL FB is available from Hoechst Celanese of Somerville, N.J. According to a chemical analysis, REMOL FB contains a mixture including about 30 wt. % potassium hydroxide, 10 wt. % anhydrous metasilicate, and the balance water. However, test dyeings have indicated that, like pure sodium hydroxide, REMOL FB is too "hot" for many classes of dyestuffs and, therefore, it would be expected to attack the dye during soaping off also.

Recently, there has been developed a new type of liquid alkali for dyeing with fiber reactive dyes which is based on potassium hydroxide and sodium silicate. This type of liquid alkali has been found to be suitable for a wide range of dyestuffs including those sensitive to "hot" mixtures. See copending application Ser. No. 07/954,589, filed Sep. 30, 1992, entitled "LIQUID ALKALI FOR REACTIVE DYEING OF TEXTILES". In addition, it has unexpectedly been found that liquid alkalis of this type may also be suitable for use during soaping off without causing the dye to hydrolyze with the water in the rinse bath.

SUMMARY OF THE INVENTION

The present invention is directed to a liquid alkali for use in soaping off of cotton and cotton blended fabrics. The liquid alkali is a water-based solution of an alkali metal hydroxide and an alkali metal silicate. Preferably the composition is an aqueous mixture of potassium hydroxide and sodium silicate. In the most preferred embodiment the composition includes 35 wt % potassium hydroxide at a 45 wt % concentration, 25 wt % sodium silicate at 50° Baumé, and the balance water. In an alternative embodiment, up to 5 wt % of a borate is added for additional buffering.

Accordingly, one aspect of the present invention is to provide a liquid composition for use in soaping off reactive dyes from cotton and cotton blended fabrics or the like. The composition includes: (a) an alkali metal hydroxide; (b) an alkali metal silicate; (c) sodium metaborate or sodium perborate; and (d) the balance water.

Another aspect of the present invention is to provide a liquid composition for use in soaping off reactive dyes from cotton and cotton blended fabrics or the like. The composition including: (a) about 10 to 74 wt % of an alkali metal hydroxide; (b) about 10 to 60 wt % of an alkali metal silicate; and (c) the balance water.

Another aspect of the present invention is to provide a liquid composition for use in soaping off reactive dyes from cotton and cotton blended fabrics or the like. The composition includes: (a) about 10 to 74 wt % of an alkali metal hydroxide; (b) about 10 to 60 of an alkali metal silicate; (c) up to about 5 wt % of sodium metaborate or sodium perborate; and (d) the balance water.

These and other aspects of the present invention will become apparent to those skilled in the art after a reading of the following description of the preferred embodiment.

DESCRIPTION OF THE PREFERRED EMBODIMENTS

In the preferred embodiment, the process for preparing the liquid alkali composition of the present invention includes the following steps: Into a mixer containing 40 parts by weight water add 35 parts by weight potassium hydroxide at a 45 wt % concentration and stir. Then add 25 parts by weight sodium silicate at 50° Baumé and stir. Stir until uniform and transfer the mixture into a suitable container.

The soaping off process using the present invention included the following sequence of steps:

1. Rinse at 120° F. for 10 minutes;
2. Rinse again at 120° F. for 10 minutes;
3. Soap at 200° F. for 10 minutes;
4. Rinse at 140° F for 10 minutes;
5. Rinse again at 120° F for 10 minutes; and
6. Dry at 200° F. until dry.

The liquid alkali of the present invention was added during the soaping step in a range of from 0.25 to 1 gms/l with 0.6 gms/l being preferred. Soaping off trials were made using various ratios of 45 wt % potassium hydroxide and 50° Baumé sodium silicate for various reactive dyes.

After soaping off, the samples were put through an AATCC Test Method 61–1975 IIA wash test. The IIA test an accelerated laundering test designed for evaluating the washfastness of a textile which is exposed to frequent laundering. The test approximates the color loss resulting from five average home launderings in one 45 minute test.

The test specimens are laundered under controlled conditions of temperature and abrasive action such that a desired color loss is obtained in a reasonable short time. The abrasive action is accomplished by the use of a low liquor ratio and an appropriate number of steel balls.

After testing, the test specimens are evaluated against a reference Gray Scale for Color Change as follows:

Class 5 negligible or no change as shown in Gray Scale Step 5;

Class 4 a change in color equivalent to Gray Scale Step 4;

Class 3 a change in color equivalent to Gray Scale Step 3;

Class 2 a change in color equivalent to Gray Scale Step 2; and

Class 1 a change in color equivalent to Gray Scale Step 1.

Generally, Classes 3, 4 and 5 are considered to be acceptable while Classes 1–2 are considered unacceptable. The results are shown below in Examples 1–21.

EXAMPLES 1–7

Conventional reaction dyeings of cotton fabrics were made. The red dye selected was a mixture of 3.50% Cibacron TM Scarlet F-3G and 1.50% Cibacron TM Red F-B. These dyes are available from Ciba-Geigy Corporation of Ardsley, N.Y. These dyes were chosen because they are sensitive to high alkalinity. Specimens were then soaped according to the previously discussed process with 0.6 gms/l of candidate material, tested according to the IIA wash test, and compared against a control having a gray scale value of 1–2.

TABLE 1

Red Dye Trial Results

| Example | Composition | | Suitable | Gray Scale |
|---|---|---|---|---|
| 1 | potassium hydroxide<br>sodium silicate<br>balance water | 35%<br>10% | Y | 2–3 |
| 2 | potassium hydroxide<br>sodium silicate<br>balance water | 35%<br>25% | Y | 3 |
| 3 | potassium hydroxide<br>sodium silicate<br>balance water | 35%<br>40% | Y | 2–3 |
| 4 | potassium hydroxide<br>sodium silicate<br>balance water | 35%<br>60% | Y | 3 |
| 5 | potassium hydroxide<br>sodium silicate<br>balance water | 10%<br>25% | Y | 2–3 |
| 6 | potassium hydroxide<br>sodium silicate<br>balance water | 50%<br>25% | Y | 2–3 |
| 7 | potassium hydroxide<br>sodium silicate<br>balance water | 75%<br>25% | Y | 2–3 |

EXAMPLES 8–14

Conventional reaction dyeings of cotton fabrics were made. The green dye selected was a mixture of 4.00% Procion TM Turquoise HA, 0.10% Procion TM Blue HERD and 0.80% Procion TM Yellow HE-6G. These dyes are available from ICI America of Wilmington, Del. Specimens were then soaped according to the previously discussed process with 0.6 gms/l of candidate material, tested according to the IIA wash test, and compared against a control having a gray scale value of 1–2.

TABLE 2

Green Dye Trial Results

| Example | Composition | | Suitable | Gray Scale |
|---|---|---|---|---|
| 8 | potassium hydroxide<br>sodium silicate<br>balance water | 35%<br>10% | Y | 3 |
| 9 | potassium hydroxide<br>sodium silicate<br>balance water | 35%<br>25% | Y | 3 |
| 10 | potassium hydroxide<br>sodium silicate<br>balance water | 35%<br>40% | Y | 3 |
| 11 | potassium hydroxide<br>sodium silicate<br>balance water | 35%<br>60% | Y | 3 |
| 12 | potassium hydroxide<br>sodium silicate<br>balance water | 10%<br>25% | Y | 2–3 |
| 13 | potassium hydroxide<br>sodium silicate<br>balance water | 50%<br>25% | Y | 3 |
| 14 | potassium hydroxide<br>sodium silicate<br>balance water | 75%<br>25% | Y | 3 |

EXAMPLES 15–21

Conventional reaction dyeings of cotton fabrics were made. The blue dye selected was a mixture of 3.00% Remazol TM Turquoise R-P and 0.50% Remazol TM Blue R-W. These dyes are available from Hoechst Celanese of Summerville, N.J. Specimens were then soaped according to the previously discussed process with 0.6 gms/l of candidate material, tested according to the IIA wash test, and compared against a control having a gray scale value of 1–2.

TABLE 3

Blue Dye Trial Results

| Example | Composition | | Suitable | Gray Scale |
|---|---|---|---|---|
| 15 | potassium hydroxide<br>sodium silicate<br>balance water | 35%<br>10% | Y | 3 |
| 16 | potassium hydroxide<br>sodium silicate<br>balance water | 35%<br>25% | Y | 3 |
| 17 | potassium hydroxide<br>sodium silicate<br>balance water | 35%<br>40% | Y | 2–3 |
| 18 | potassium hydroxide<br>sodium silicate<br>balance water | 35%<br>60% | Y | 3 |
| 19 | potassium hydroxide<br>sodium silicate<br>balance water | 10%<br>25% | Y | 2–3 |
| 20 | potassium hydroxide<br>sodium silicate<br>balance water | 50%<br>25% | Y | 2–3 |
| 21 | potassium hydroxide<br>sodium silicate<br>balance water | 75%<br>25% | Y | 2–3 |

These results clearly show that the present invention, as shown in Examples 1–21, will provide good IIA wash test results on various dyes, including alkali sensitive dyes, for typical amounts of alkali of 0.25 to 1 gms/l in the dyebath. The above examples also show that the present invention is an acceptable substitute for phosphorus-based detergents for soaping off reactive dyed cotton and cotton blended fabrics or the like.

Accordingly, the amount of silicate in the present invention can be varied between a low of about 10 to a high of about 60 wt % of 50° Baumé with 25 wt % being most preferred. Similarly, the amount of 45 wt % concentration alkali metal hydroxide in the present invention can be varied between a low of about 10 to a high of about 74 wt % with 35 wt % being most preferred. Thus, the preferred composition of the present invention has the following properties:

Appearance: Clear liquid

1% pH: 12.2–12.4

45 wt % Potassium Hydroxide: 10–74 wt %

50° Baumé Sodium Silicate: 10–60 wt %

This provides a liquid alkali product that can be used at between about 0.25 to 1 gms/l in the rinse bath.

In the preferred embodiment, the present invention also includes adding up to about 5 wt % sodium metaborate or sodium perborate to the liquid alkali as a final step. The borates act as a buffer. The liquid alkalis containing borates have a more gradual pH titration slope than the liquid alkali without borate. However, as shown above, the rinse bath tests have shown that the mixture can be made without the borate and still provide satisfactory IIA results.

Finally, IIA wash tests were made for the same dyes as Examples 1–21 but using 0.6 gms/l of "REMOL FB" in the bath during the soaping off step. As discussed above, test dyeings had indicated that, like pure sodium hydroxide, REMOL FB is too "hot" for many classes of dyestuffs and, therefore, it would be expected to attack the dye during soaping off also. However, satisfactory IIA test results were obtained in the range of 2–3 to 3.

Certain modifications and improvements will occur to those skilled in the art upon reading of the foregoing description. By way of example, sodium hydroxide could be used in place of potassium hydroxide. Also, carbonates are possible substitutes for the borates. It should be understood that all such modifications and improvements have been deleted herein for the sake of conciseness and readability but are properly within the scope of the following claims.

We claim:

1. A process for soaping off excessive reactive dyes from cotton and cotton blended fabrics subsequent to dyeing, said process including sequentially a rinse step, a soap step, and a rinse step, said process comprising the step of introducing a mixture of an alkali metal hydroxide, an alkali metal silicate and a borate selected from the group consisting of sodium metaborate, sodium perborate, and borax, during the soap step, wherein said mixture includes: (a) about 5 to 35 wt % of an alkali metal hydroxide; b) about 10 to 40 wt % of an alkali metal silicate at 50° Baumé; (c) about 5 wt % of a borate; and (d) the balance water.

2. The process according to claim 1, wherein said alkali metal hydroxide and said alkali metal silicate are selected from the group consisting of potassium and sodium.

* * * * *